United States Patent [19]

Edamura

[11] Patent Number: 4,972,060

[45] Date of Patent: Nov. 20, 1990

[54] MICROWAVE OVEN WITH MICROCOMPUTER OPERATED ACCORDING TO COOKING PROGRAMS STORED IN A MEMORY

[75] Inventor: Kaoru Edamura, Nara, Japan

[73] Assignee: Sharp Kabushiki Kaisha, Osaka, Japan

[21] Appl. No.: 425,329

[22] Filed: Oct. 23, 1989

[30] Foreign Application Priority Data

Oct. 28, 1988 [JP] Japan ..... 63-274239

[51] Int. Cl.[5] ..... H05B 6/68

[52] U.S. Cl. ..... 219/10.55 B; 219/10.55 E; 219/506; 99/325

[58] Field of Search ..... 219/10.55 B, 10.55 R, 219/10.55 E, 506; 99/325, 451; 364/477

[56] References Cited

U.S. PATENT DOCUMENTS 4,131,786 12/1978 Cooper ..... 219/10.55 B
4,339,646 7/1982 Doi et al. ..... 219/10.55 B
4,459,449 7/1984 Hirata ..... 219/506
4,568,810 2/1986 Carmean ..... 219/10.55 B
4,816,635 3/1989 Edamura ..... 219/10.55 B
4,837,414 6/1989 Edamula ..... 219/506

*Primary Examiner*—Philip H. Leung

[57] ABSTRACT

A microwave oven has a build-in microcomputer and a memory for cooking information so that heating can be controlled according to a cooking program selected from the cooking information stored in the memory. Also, the microwave oven has a cooking category selector used to select a specific cooking category based on the cooking information stored in the memory, a cooking category display which displays the cooking category selected by the cooking category selector, a menu display which displays a specific number of menu names contained in the specific cooking category selected by the cooking category selector based on the cooking information stored in the memory, and a menu selector used to select a desired menu name from among the multple menu names displayed on the menu display.

8 Claims, 10 Drawing Sheets

MICROWAVE OVEN WITH MICROCOMPUTER OPERATED ACCORDING TO COOKING PROGRAMS STORED IN A MEMORY

BACKGROUND OF THE INVENTION

1. Industrial Application Field

The present invention relates to a microwave oven which has a built-in microcomputer and which is operated according to cooking programs stored in a memory device.

2. Description of Background

As the heating functions of microwave ovens have been developed, the number of usable heating and cooking methods has increased, and the range of cookable menus has expanded. As the number of cooking menus has expanded, many menus have been automated through microcomputer control of microwave heat cooking, conventional heat cooking, and combination microwave and conventional heat cooking. For the purpose of the operator's being able to easily use these automatic heat cooking methods, menu keys and other selection functions have been provided on the control unit as will be described below to call the cooking program associated with a specific menu selection.

FIG. 8 shows the external appearance of a conventional microwave oven. Numeral 31 is the outer cabinet, 32 is the control unit, 33 the oven cavity, 34 the oven door, 35 the oven tray, and 36 the heating element.

FIG. 9 is an enlarged view of the panel on control unit 32. This panel is comprised of the following elements. Specifically, display 38, heating key 39, first menu keys 40, cancel key 41, second menu keys 42, door 43, heat mode selector keys 45, and timer control 46. As shown in FIG. 10, the operating unit containing the first and second menu keys and other controls of control unit 32 is comprised of an overlay 47 imprinted with the outlines of the menu keys and/or the names of the menu keys with an electrical contact provided to the back side of each key, a circuit board 50 provided with input switches, a membrane sheet 48 which assures a positive connection between the contact on overlay 47 and the corresponding input switch on circuit board 50 when overlay 47 is pressed at a specific key position, and a spacer 49.

However, in a conventional microwave oven in which heat cooking has been automated, multiple menu keys 40, 42 are provided on the control unit 32 so that the user can easily select the desired cooking program. The proliferation of so many keys and buttons however, conversely makes the menu heys 40, 42 small and makes the menu display confusing and hard to read, and it is therefore not easy to quickly find and select the desired menu key. As a result, a door 43 is used to hide the least frequently used second menu keys 42 from the sight of the user, but while this is intended to make operation easier, it conversely makes operation more complicated. Furthermore, since menu keys 40, 42 become small, the operator not infrequently may also press the menu key beside the desired menu key 40, 42.

SUMMARY OF THE INVENTION

Therefore, the object of the present invention is to provide a microwave oven which is easy to operate and free of operating errors.

In order to achieve the aforementioned object, a microwave oven according to the present invention has a microcomputer and a memory for cooking information wherein heating is controlled according to a cooking program selected from the cooking information stored in the memory, and comprising a cooking category selector used to select a specific cooking category based on the cooking information stored in the memory, a cooking category display which displays the cooking category selected by the cooking category selector, a menu display which displays a specific number of menu names contained in the specific cooking category selected by the cooking category selector based on the cooking information stored in the memory, and a menu selector used to select a desired menu name from among the multiple menu names displayed on the menu display.

In addition, it is desirable that the microwave oven as described above comprises an external data storage device which stores the cooking information to be stored in said memory.

It is also desirable that said microwave oven is provided with a menu image display comprised of a liquid crystal display used to display an image of finished appearance of a menu item selected by the menu selector.

It is preferable that said microwave oven comprised of a menu image display comprises a menu confirmation unit used to confirm selection of the menu item displayed on the menu image display.

It is also preferred that in a microwave oven comprised of said menu confirmation unit as thus described, the menu confirmation unit is the menu selector, and the menu selection is confirmed by consecutively selecting the same menu item twice.

The desired cooking category is selected using the cooking category selector by referring to the cooking category names displayed on the cooking category display according to the cooking information stored in the memory. When the selection is made, a specific number of menu names contained within the cooking category selected by the cooking category selector are displayed on the menu display, and the desired menu name is selected using the menu selector. Specifically, a specific number of menu names for each cooking category are sequentially displayed according to the cooking information stored in the memory, and the desired menu is chosen from among the displayed menus.

Furthermore, by providing the above microwave oven with an external storage device to store in categories the cooking information stored in the memory, if the cooking information stored in this external storage device is input to the built-in memory of the microwave oven, the specific cooking category can be easily selected with the cooking category selector from among a wide selection of categorized cooking information.

In addition, if the above microwave oven is provided with a menu image display comprised of a liquid crystal display to display an image of the finished menu selected by the menu selector, the operator can confirm the selection of the menu on the menu image display when such is chosen by the menu selector.

In addition, the desired menu can be confirmed by the user after confirming finish condition on the menu image display if the menu item for which the finished condition is displayed on the menu image display is confirmed by means of a menu confirmation unit on the microwave oven comprised of said menu image display.

Furthermore, on a microwave oven comprised of the menu confirmation unit, the construction of the menu confirmation unit can be simplified if the menu confirmation unit is also the menu selector and the menu selection is confirmed by means of two consecutive selections of the same menu item using the menu selector.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become clear from the following description taken in conjunction with the preferred embodiments thereof with reference to the accompanying drawings which are given by way of illustration only, and thus are not limitative of the present invention and throughout which, like parts are designated by like reference numerals, and in which.

DETAILED DESCRIPTION OF THE PREFERRED EMBODIMENT

The preferred embodiments of a microwave oven according to the present invention are described herein below with reference to the accompanying diagrams.

Figure 1:
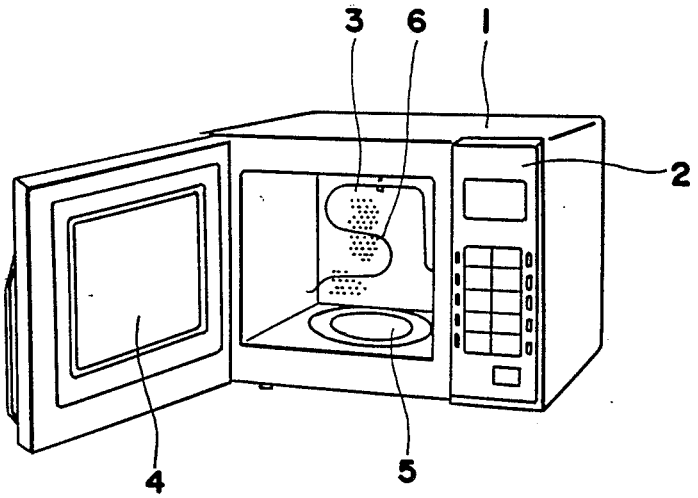
FIG. 1 is an external view of a first embodiment of a microwave oven according to the present invention.
Figure 8:
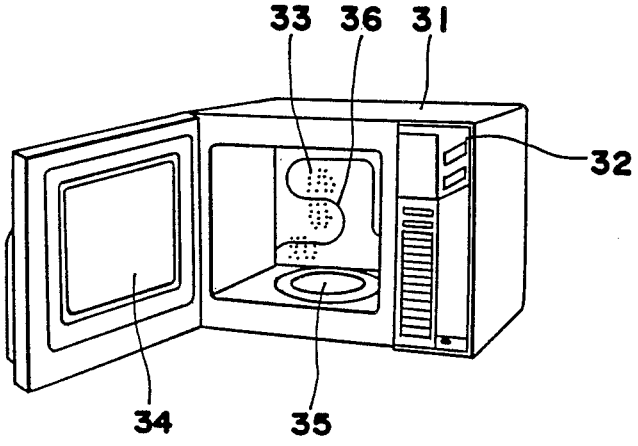
Fig. 8 PRIOR ART
FIG. 8 is an external view of a conventional microwave oven.
Figure 9:
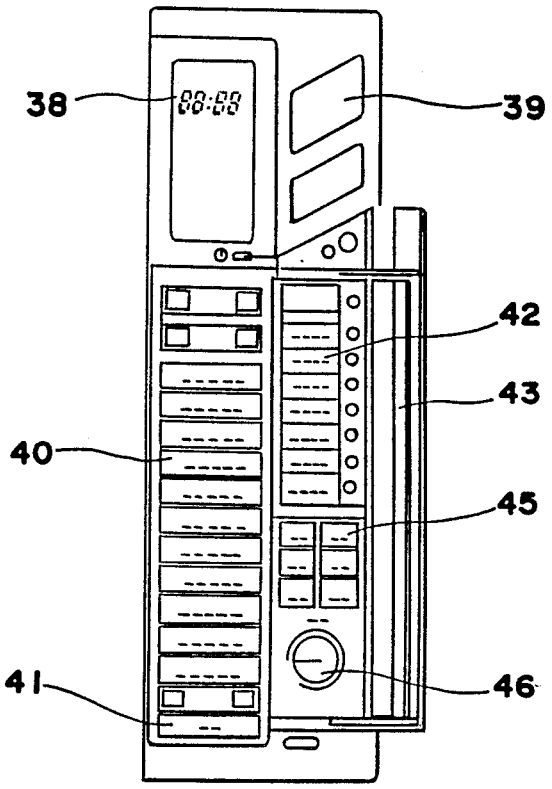
Fig. 9 PRIOR ART
FIG. 9 is an enlarged view of the panel of the control unit in the above conventional microwave oven.
Figure 10:
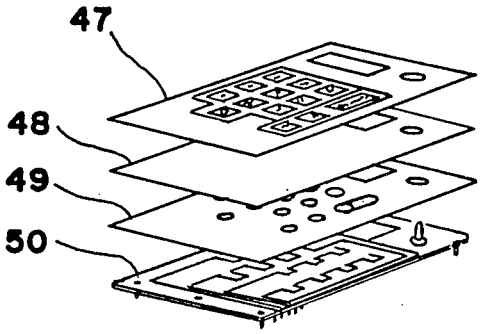
Fig. 10 PRIOR ART
FIG. 10 is an exploded drawing of the construction of the conventional control unit.

FIG. 1 is a diagram of the outside of a microwave oven according to the present invention. The appearance of this microwave oven is basically the same as that shown in FIG. 8. Reference number 1 is the outer cabinet, 2 is the control unit, 3 is the oven cavity, and 4 is the oven door. Oven tray 5 is the tray on which the food to be heated is placed, and rotates so that the food is evenly irradiated with microwaves when in the microwave cooking mode. The heating element 6 is comprised of both a microwave heating means and a conventional heating mean such as a resistance heater. The heat cooking mode, which may be either or a combination of microwave and conventional heat cooking, is automatically selected according to the menu and cooking mode chosen by control unit 2.

The present invention relates particularly to an improvement of control unit 2. The construction and operation of the control unit 2 is therefore described in detail below.

Figure 2:
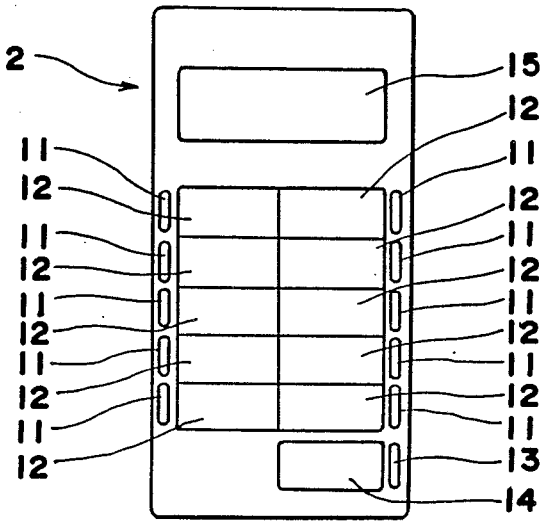
FIG. 2 is a front view of the control unit.
Figure 3:
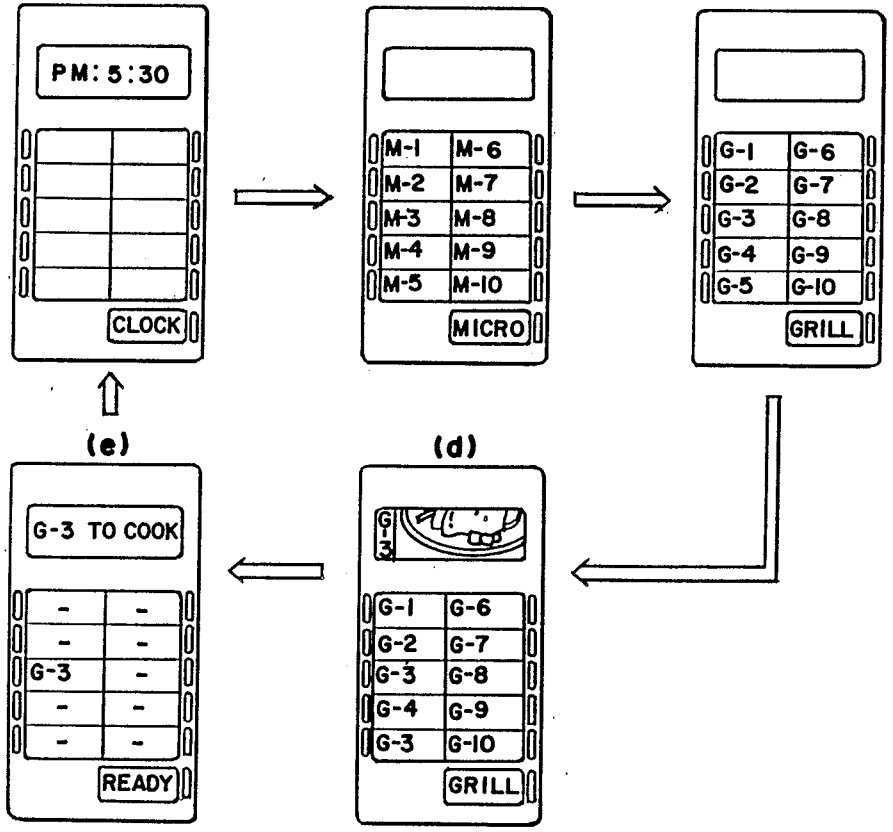
FIG. 3 is a figure showing sample displays of the display member of the control unit.

FIG. 2 is a front view of the operating part of control unit 2. FIG. 3 shows various sample displays in the display part of the control unit 2. Menu switches 11 are push switches. When a switch is pressed, a specific cooking program is selected and the program is sent to the microcomputer, which controls the heating and cooking process as will be described in detail below. Menu name displays 12 are comprised of color liquid crystal display devices which display visual information enabling the operator to visually identify menu name information or the menu names themselves. Sample displays are shown in FIGS. 3 (*b*), (*c*), and (*d*) (in the present embodiment, the menu name information is displayed). The operating mode selection switch 13 is also a push switch. Each time the switch is pressed, the operating mode changes in a predetermined order as illustrated in FIG. 3 where the mode changes from FIG. 3 (*a*) to (*b*) to (*c*) to (*d*) and then to (*e*), from which the mode returns to the first operating mode (FIG. 3 (*e*) to 3 (*a*)).

In the preferred embodiment described herein, these operating modes consist of the following:

(1) Clock display mode (sample display: CLOCK), a normal clock display when not in a cooking mode;

(2) Microwave cooking mode (sample display: MICRO), the mode in which food is heated by microwave radiation;

(3) Grill cooking mode (sample display: GRILL), the mode in which food is heated by heat generated from a heating element;

(4) Convection cooking mode (sample display: CONVEC), the mode in which food is heated by forced convection of air heated by the heating element and circulated inside the oven by a fan;

(5) Contents mode (sample display: CONTENTS), the mode in which information input from an external source is displayed;

(6) Cooking preparations ready mode (sample display: READY), the mode in which the cooking program for the selected menu name is loaded into the memory of heat cooking controller.

The number of usable cooking menus thus increases with the provision of multiple cooking modes. The operating mode name display 14 is also comprised of a color liquid crystal display and displays the name of the operating mode selected by operating mode selection switch 13, for example CLOCK or MICRO, as shown in FIGS. 3 (*a*)–(*e*).

Display 15 is also comprised of a color liquid crystal display and displays an image of the finished food for the menu selected by pressing menu switches 11 as shown in FIG. 3 (*d*). In addition, display 15 will also display instructions for the selected menu. For example, if the selected menu is steak, it may display "Turn Over" when it is time to turn the steak over, and "Seasoning" when it is time to apply pepper or other seasoning.

Figure 4:
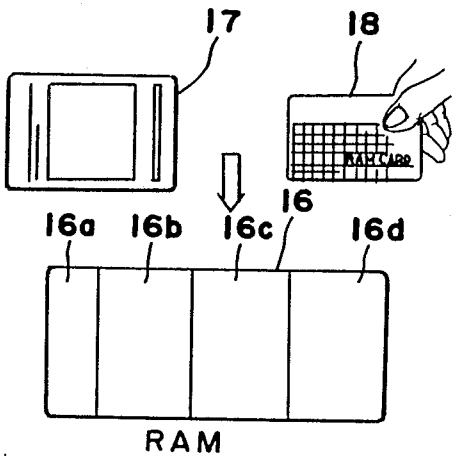
FIG. 4 is a figure showing the memory structure of the main memory and an external view of the external storage device.

FIG. 4 shows a storage means to store various information used to execute the menu selection processing operations. IC (integrated circuit) card 17 or RAM (random access memory) card 18 is an external storage devices used to store a variety of information for input to main memory 16. The external storage devices 17 or 18 may store the following kinds of information.

(1) Contents information: information used to display the contents of registered information;

(2) Cooking program information;

(3) Menu image information, image information of the menu conditions when cooking is finished;

(4) Menu name information, menu name character information or image information which will visually identify the menu name.

The information input from external storage device 17 or 18 is stored as described below in the corresponding data area in main memory 16. Specifically, the contents information is stored in contents information data area 16*a*, the cooking program information is stored in cooking program data area 16*b*, menu image information is stored in menu image information data area 16*c*, and menu name information is stored in menu name information data area 16*d*.

Figure 5:
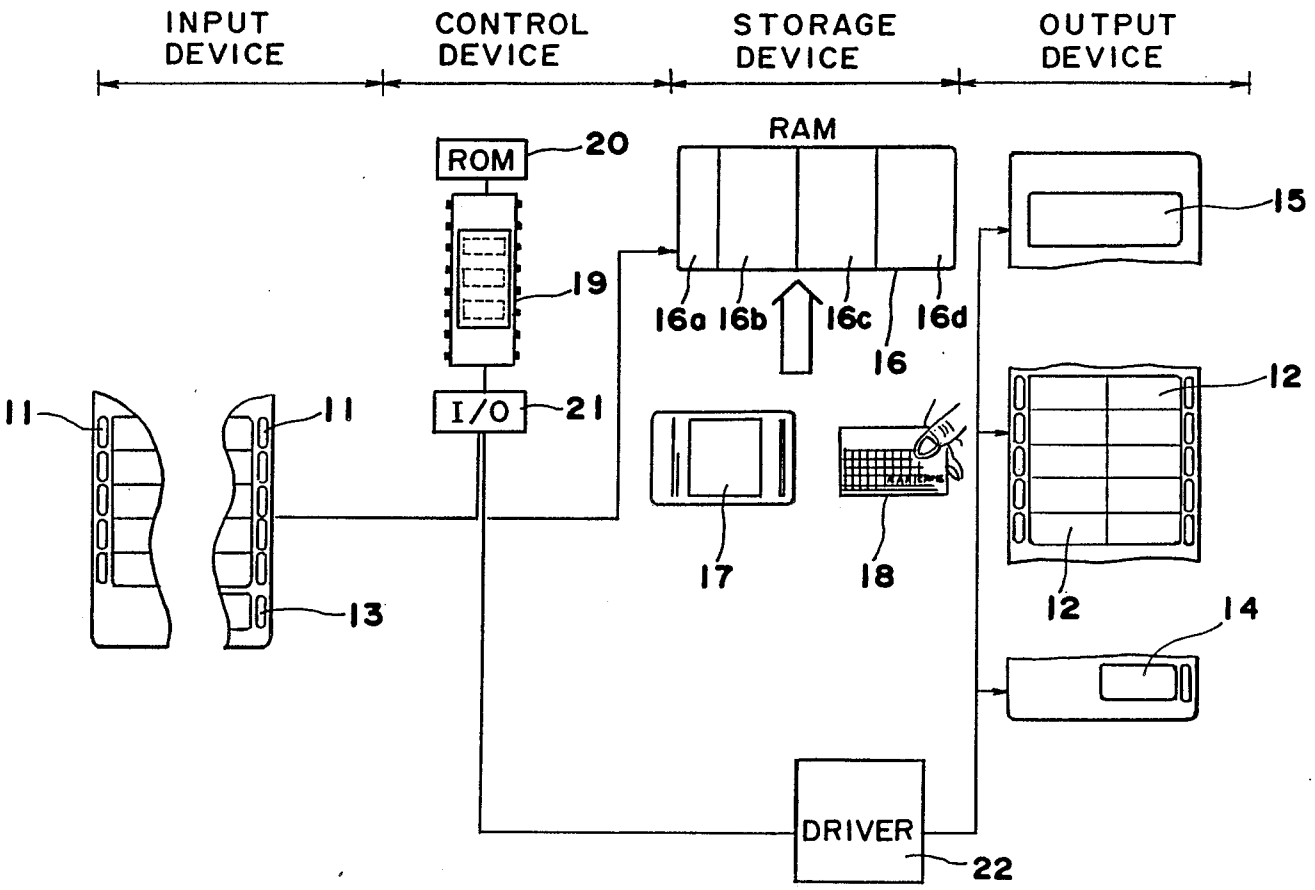
FIG. 5 is a block diagram of the control unit.

FIG. 5 is a block diagram of the control unit 2. It is separated from the left of the figure into an input device, control device, storage device, and output device.

The input device is the device used by the operator to specify the desired operating mode and menu, and is comprised of menu switches 11 and operating mode selection switch 13. The control device controls the operation of control unit 2, and is comprised of a central processing unit (CPU) 19, control ROM (read-only memory) 20, and input/output interface 21. The storage device is a memory device used to store the information required for the operation of control unit 2, and is comprised of main memory 16 and external storage device 17 or 18. The output device is the means used to display the operating mode names, menu names, and the images, of finished, menus selected by the operator. The output device is comprised of menu name displays 12, operating mode name display 14, and display 15. This output device is connected to I/O interface 21 through driver 22.

The microwave oven operates as described below to execute the menu selection process and cooking information input process.

Figure 6A:
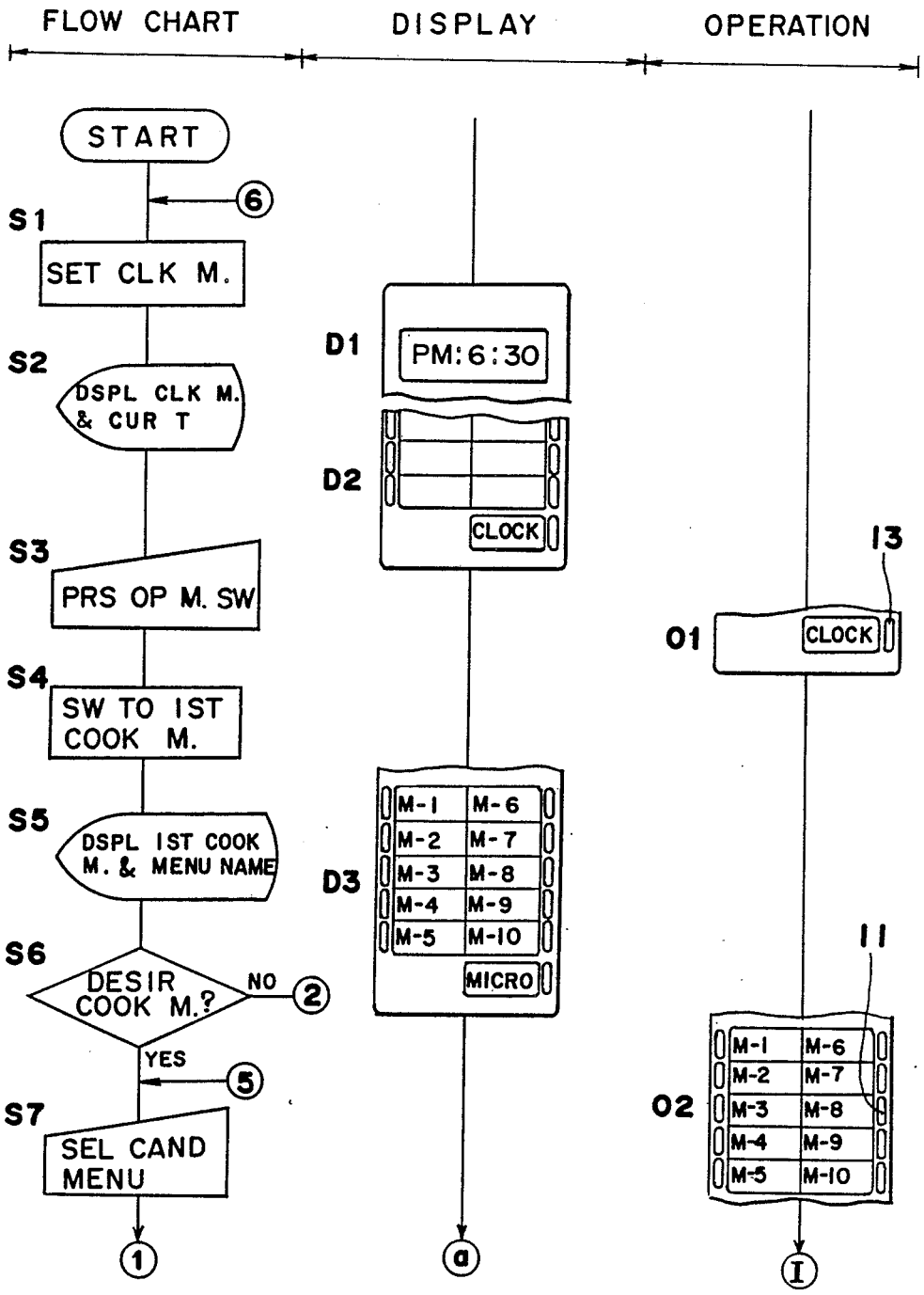
FIGS. 6 (*a*), (*b*), and (*c*) are flow charts of the menu selection process.
Figure 6B:
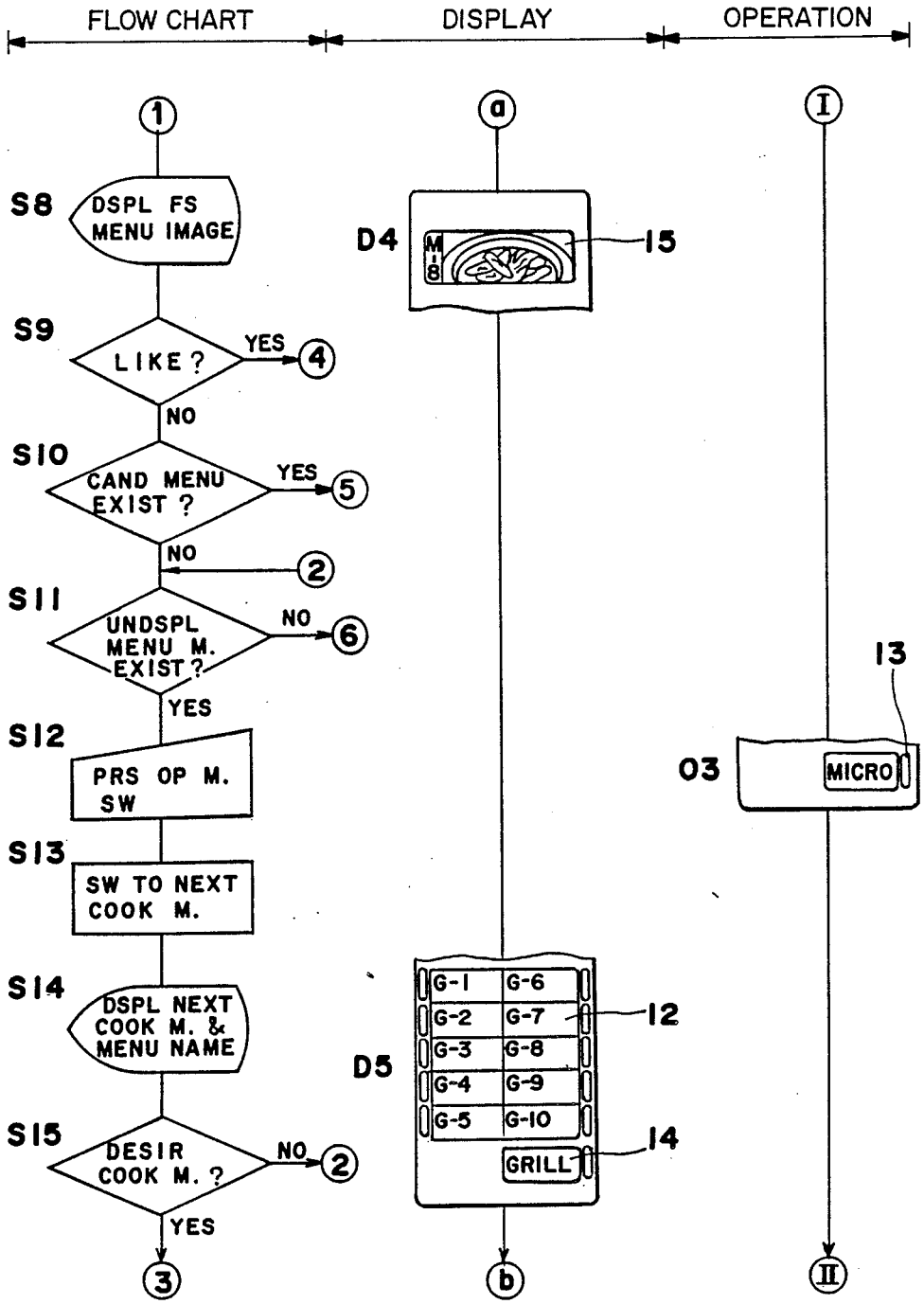
Figure 6C:
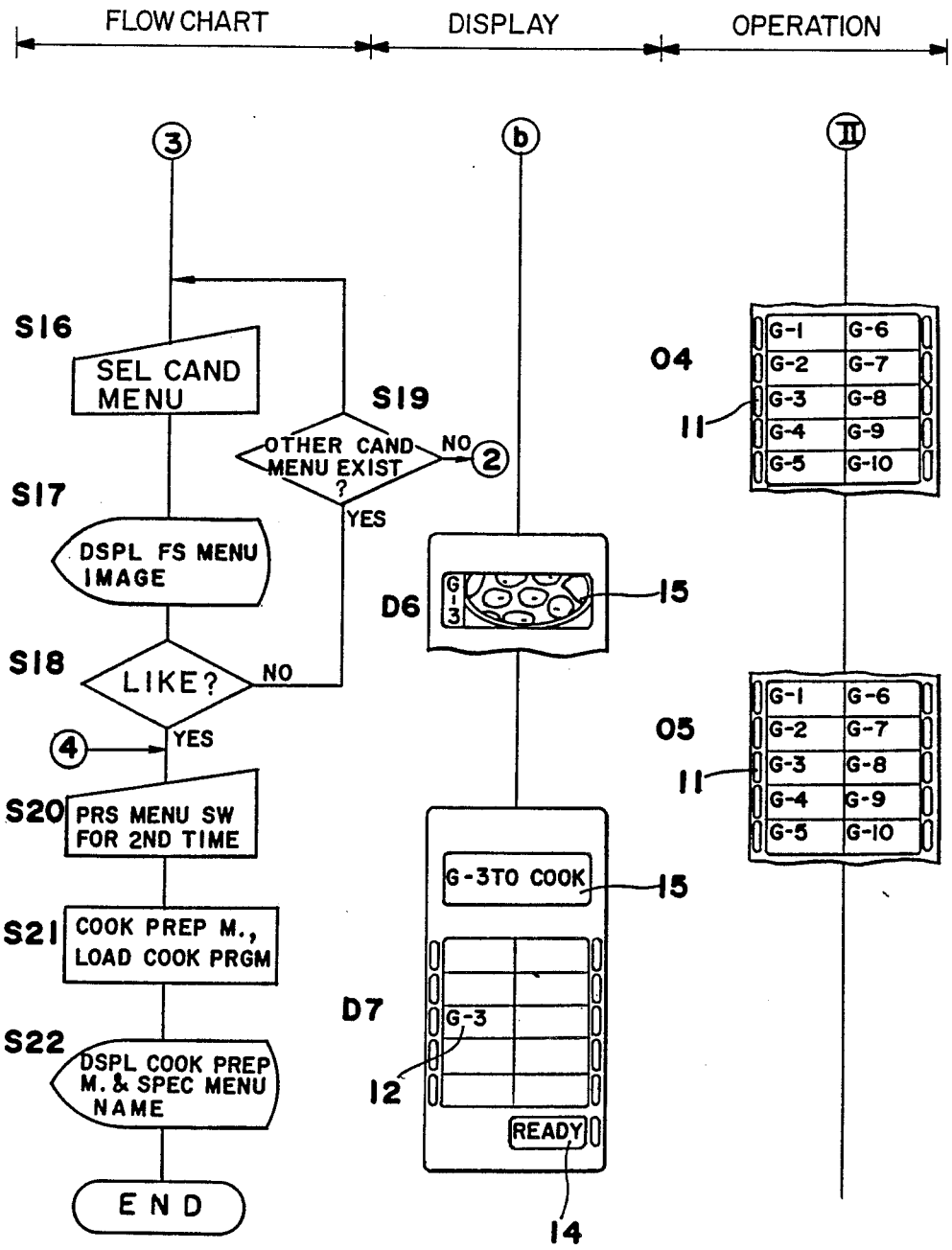

FIGS. 6 (*a*), (*b*), and (*c*) are flow charts of the menu selection process operation. The following description of microwave oven operation and the menu selection process will be based on FIGS. 6 (*a*), (*b*), and (*c*). The right side of the figure shows the operation, the center shows what is displayed at that time on the display of the control unit 2, and the left shows the flow chart of the program.

At step S1, the operating mode is automatically set to the clock mode when the control unit 2 is connected to a power supply.

At step S2, CLOCK is displayed in operating mode name display 14 as shown in display step D2 so that the operator can be informed that the clock mode is currently set. The current time set by a rotary encoder, not shown in the figures, is also displayed in display 15 as shown in display step D1.

At step S3, operating mode selection switch 13 is pressed as indicated by operation step O1.

At step S4, the operating mode is automatically switched to the first cooking mode, which is displayed first.

At step S5, the name of the first cooking mode is displayed in operating mode name display 14 and indicated by display step D3 (MICRO in the present embodiment). Furthermore, the menu name information contained within cooking mode MICRO is read from menu name information data area 16*d*, and based on this menu name information the menu name (M-1 to M-10 in the present embodiment) is displayed in menu name displays 12.

At step S6, it is determined whether or not the desired cooking mode is contained within the cooking mode names displayed in operating mode name display 14. If the result is yes, operation advances to step S7. If the name is not displayed, operation skips to step S11.

At step S7, the menu switch 11 corresponding to the desired candidate menu name (M-8 in this example) is pressed as indicated by operation step O2, and the selection of the desired candidate menu name is specified.

At step S8, the menu image information showing how the selected menu candidate will look when finished is read from menu image information data area 16*c*, and based on this menu image information a picture of the selected menu candidate when finished is displayed on display 15 as indicated by display step D4.

At step S9, the operator decides whether or not the candidate menu displayed in display 15 in step S8 above is of liking. If the selection is correct, operation skips to step S20. If not, operation advances to step S10.

At step S10, it is determined whether or not there are other candidate menus. If there are other candidate menus, operation returns to step S7 and the next candidate menu is selected. If not, operation advances to step S11.

At step S11, it is determined whether or not there are any undisplayed cooking modes. If there are, operation advances to step S12. If not, operation returns to step S1, the clock mode is reset, and the current time is displayed in the standby mode until the next operating mode selection switch 13 is pressed.

At step S12, operating mode selection switch 13 is pressed as indicated by operation step O3.

At step S13, the operating mode switches to the next cooking mode to be displayed.

At step S14, the name of the next cooking mode is displayed in operating mode name display 14 and indicated by display step D5 (GRILL is the second cooking mode in the present embodiment). Furthermore, the menu name information contained within that cooking mode (GRILL) is read from menu name information data area 16*d*, and based on this menu name information, the menu name (G-1 to G-10 for the second cooking mode in the present embodiment) is displayed in menu name displays 12 as indicated by display step D5.

At step S15, it is determined whether or not the desired menu is contained within the candidate menus displayed in menu name displays 12. If the result is yes, operation advances to step S16. If the name is not displayed, operation returns to step S11.

At step S16, the menu switch 11 corresponding to the desired candidate menu name (G-3 in this example) is pressed as indicated by operation step O4, and the selection of the desired candidate menu name is executed.

At step S17, the menu image information showing how the selected menu candidate will look when finished is read from menu image information data area 16*c*, and based on this menu image information, a picture of the selected menu candidate when finished is displayed on display 15 as indicated by display step D6.

At step S18, the operator decides whether or not the candidate menu displayed in display 15 in step S17 above is of liking. If the selection is correct, operation skips to step S20. If not, operation advances to step S19.

At step S19, it is determined whether or not there are any other candidate menus. If there are, operation returns to step S16 and the next candidate menu is selected and specified. If not, operation advances to step S11.

At step S20, menu switch 11 corresponding to the selected menu, for which an image of when the menu is finished is displayed in display 15 at step S8 or step S17, is pressed again as shown by operation step O5, and the cooking mode and menu are thus confirmed.

At step S21, when the menu switch 11 is pressed for a second time in step S20, the operating mode automatically switches to the cooking preparation mode. Then, the cooking program for the menu specified in step S20 is read from cooking program data area 16*b* of main memory 16, and is loaded into the memory area of the heating and cooking controller (not shown) of the microwave oven.

At step S22, the cooking preparation mode is indicated as shown in display step D7 with READY displayed in operating mode name display 14. Furthermore, the specified menu name is displayed and the sentence "G-3 TO COOK" is displayed in display 15. At the same time, as shown by display step D7, the display of the other menu names in menu name displays 12 is ended, leaving only menu name G-3 displayed, and the menu selection process is thus completed.

The menu selection process operation thus proceeds as described above, but if the desired menu name is not included in any of the menu names stored in main memory 16, it is necessary to renew the information stored in main memory 16.

Figure 7A:
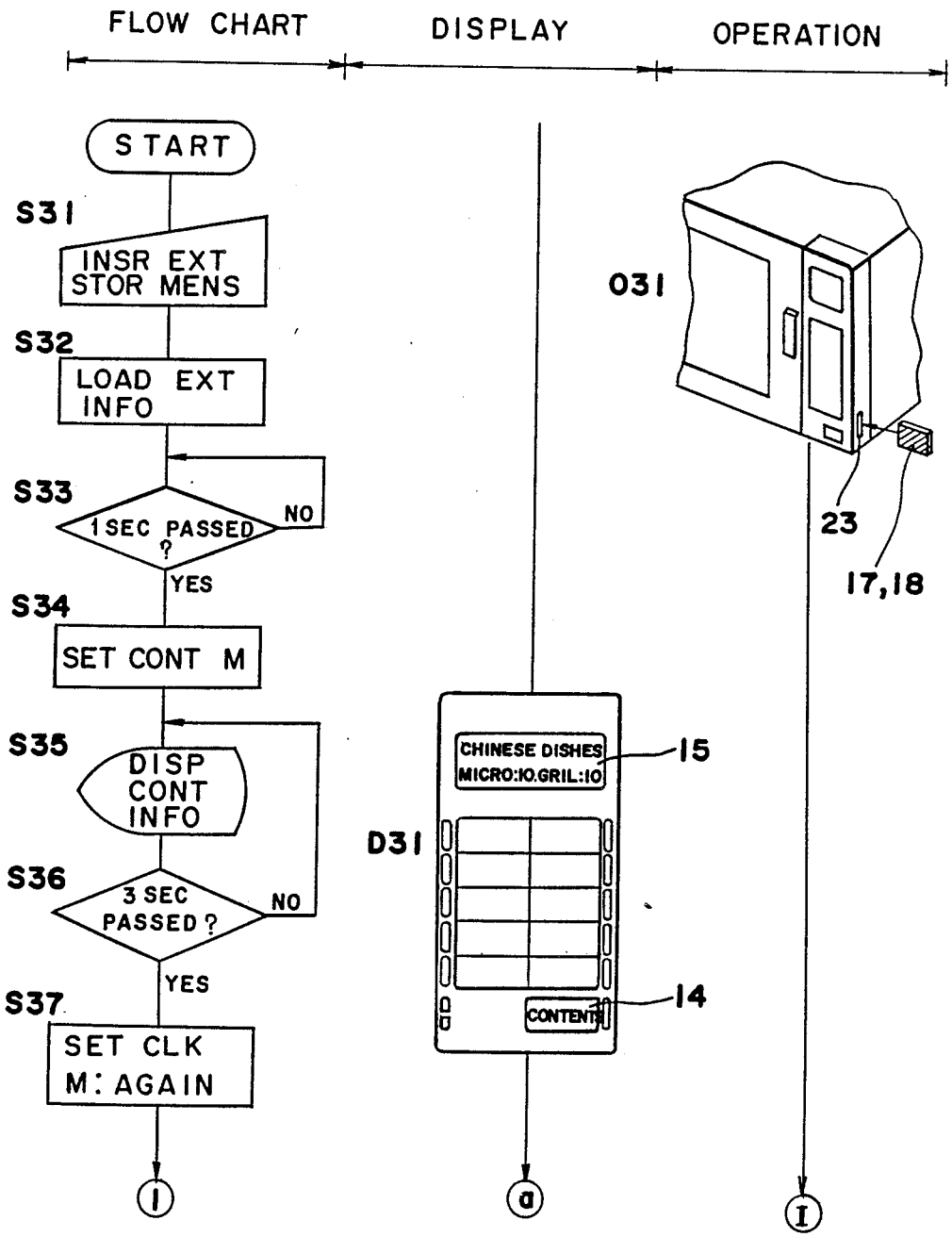
FIGS. 7 (*a*), (*b*), and (*c*) are flow charts of the cooking information input process.
Figure 7B:
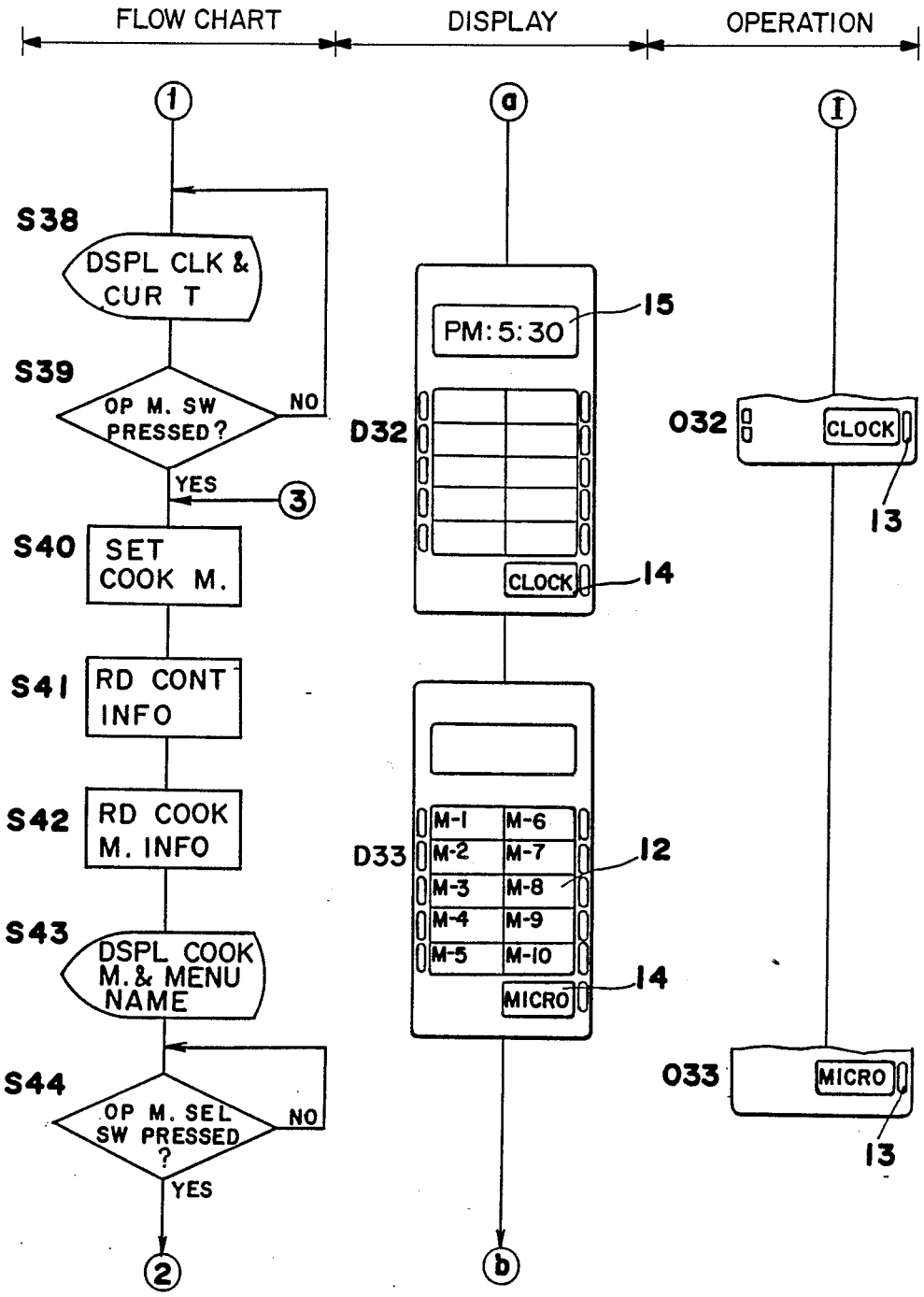
Figure 7:
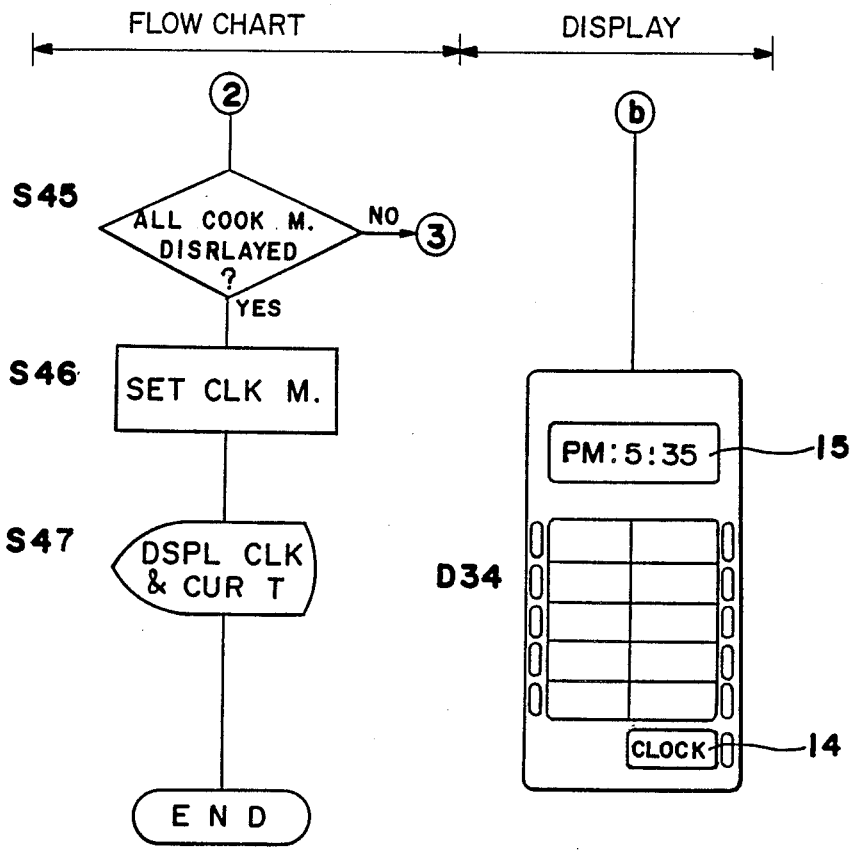

FIGS. 7 (*a*), (*b*), and (*c*) are flow charts of the cooking information input process whereby information from the external storage device is loaded into main memory 16 to renew the contents of main memory 16 and the input contents are then confirmed. This cooking information input process is described in detail below with reference to FIGS. 7 (*a*), (*b*), and (*c*).

At step S31, the IC card 17, RAM card 18, or other external storage means is inserted into the side slot 23 of the microwave oven as shown by operation step O31.

At step S32, the information stored in external storage device 17, 18 is loaded into main memory 16.

At this time, the contents information is stored in contents information data area 16*a*, the cooking program information is stored in cooking program data area 16*b*, menu image information is stored in menu image information data area 16*c*, and menu name information is stored in menu name information data area 16*d* as was previously described. In addition, the cooking mode name display order information, which tells the order in which the cooking mode names are to be displayed on operating mode name display 14 when confirming the cooking mode, is stored in main memory 16.

At step S33, it is determined whether or not 1 second has passed since the external storage device 17, 18 was inserted in slot 23. If the answer is yes, loading of data to main memory 16 is completed, and operation advances to step S34.

At step S34, the operation mode is set to the contents mode, and "CONTENTS" is displayed in operating mode name display 14 as shown in display step D31.

At step S35, the contents information stored in contents information data area 16*a* of main memory 16 is read out and displayed in display 15 as shown in display step D31.

This contents information contains the following two types of information. Specifically, the menu category name (e.g., "CHINESE DISHES" or "SPANISH DISHES"), and the menu number for each cooking mode (e.g., "MICRO:10", or "GRILL:10").

At step S36, it is determined whether or not 3 seconds have passed since the contents information was displayed in step S35. If 3 sec. have passed, operation advances to step S37; if not, operation returns to step S35 and display of the contents information continues.

At step S37, the operation mode changes to the clock mode again.

At step S38, CLOCK is displayed in operating mode name display 14 as shown in display step D32 indicating that the oven is in the clock mode, and the current time is displayed in display 15.

As described above, the cooking programs used for cooking with a microwave oven according to the present invention can be supplied from IC card 17 or RAM card 18 as other external data storage means. At this time, when the operator selects a menu, IC cards 17 or RAM cards 18 for specific menu categories (e.g., "CHINESE DISHES" or "SPANISH DISHES") and microwave oven heating methods (microwave, microwave+grill heating, microwave+grill heating+convection heating) are prepared so that the appropriate IC card 17 or RAM card 18 can be chosen more easily.

The cooking mode name and menu names in the cooking mode stored in main memory 16 are confirmed as described below. At this time, it shall be assumed that the cooking mode name information is provided in control ROM 20.

At step S39, it is determined whether operating mode selection switch 13 has been pressed as shown in operation step O32. If it has been pressed, operation advances to step S40. If not, operation returns to step S38 and the CLOCK and current time displays continue.

At step S40, the operating mode switches to the cooking mode.

At step S41, the cooking mode name display order information stored in contents information data area 16*a* of main memory 16 is read out.

This cooking mode name display order information may consist of the following kinds of information. Specifically, the first letter in each cooking mode name ("Micro" gives "M", "grill" gives "G", "convec" gives "C"), or the address in control ROM 20 at which the cooking mode name is stored.

At step S42, the cooking mode name information is read out from control ROM 20 based on the cooking mode name display order information read in step S41.

At step S43, the cooking mode names are displayed in operating mode name display 14 as shown in display step D33 based on the cooking mode name information read in step S42. In addition, the menu names contained in the cooking mode name information read as described above are read from menu name information data area 16*d* and displayed on menu name displays 12.

At step S44, it is determined whether operating mode selection switch 13 has been pressed as shown in operation step O33. If it has been pressed, operation advances to step S45.

At step S45, it is determined whether or not all cooking mode names have been displayed based on the cooking mode name display order information stored in contents information data area 16*a*. If all names have been displayed, operation advances to step S46. If not, operation returns to step S40, and the next cooking mode names and menu names are displayed.

At step S46, the operating mode is reset to the clock mode.

At step S47, CLOCK is displayed in operating mode name display 14 as shown in display step D34 indicating that the oven is in the clock mode, the current time is displayed in display 15, and the cooking information input process is completed.

Thus, a microwave oven according to the present invention has the information for multiple prepared menu cooking programs categorized into menu categories or heat cooking methods and stored in external storage devices 17, 18. Specifically, by loading this various information from external storage device 17 or 18 into main memory 16, the operator is able to display only the group of menu names related to the required menu category or heat cooking method based on the names appended to the categories. Therefore, the number of menu names displayed in display 15 when looking for the desired menu is limited (ten in this embodiment), thus making it easier to find and select the desired menu. This makes it possible to make menu switches 11 a size larger, easier to use, and this prevents the accidental pressing of multiple menu switches 11 when pressing a single switch 11.

Furthermore, because the cooking information is stored in external storage device 17 or 18 and the desired menu is selected after the information in the external storage devices 17, 18 is loaded in the main memory 16 of control unit 2 and displayed, the displayed group of menu names can be changed by simply changing the external storage device 17 or 18. As a result, it is possible to change the display between a large number of menu names, resulting in superior operability. In the case of the conventional microwave oven shown in FIG. 8, if the cooking information contents of the storage device are changed by loading additional information from an external storage device, it is necessary to also change the overlay.

In addition, because only the chosen menu name is displayed after the desired menu is selected and the other menu names are erased from the display, it is easier to confirm the chosen menu item.

In the embodiment described above, the control unit according to the present invention is added to a microwave oven with multiple heating functions, but it can obviously also be installed on a microwave oven with one or a few heating functions.

As will be clear from the above description of a microwave oven according to the present invention, when cooking category names are displayed in a cooking category display based on the cooking information stored in a memory device, and the cooking category is selected referring to the displayed cooking category names using a cooking category selector, a specific number of menu names contained in the selected cooking category are displayed in the menu name display, and the desired menu is selected from among the displayed menu names using a menu selector. Therefore, the menu names displayed in the above menu name display are limited to the specific number of menus contained in the same cooking category. Thus, it is sufficient to provide only the above specific number of menu name displays and menu selectors, and the size of each can therefore be made large enough to prevent any adverse effect on microwave oven operability. Therefore, it is possible to provide a microwave oven that is easy to operate and free of accidental operation errors.

Furthermore, because a microwave oven according to the present invention is provided with an external storage device containing a variety of categorized cooking information for input and storage in the main memory device of the microwave oven, a specific cooking category can be easily selected from the above external storage device according to the categorized cooking means.

Furthermore, because a microwave oven according to the present invention displays an image when finished of the menu selected by the menu selector on a menu image display, the finished form of the menu selected by the menu selector can be confirmed visually on the screen.

Furthermore, because a microwave oven provided with the above menu image display confirms the menu for which the finished state is displayed in said menu image display by means of a menu confirmation device, the menu selection can be confirmed after confirming in the menu image display how the menu will appear when finished.

Furthermore, in a microwave oven comprised of said menu confirmation device, because the menu confirmation device is also the menu selector and the menu is confirmed by twice consecutively specifying the same menu name with the menu selector, the construction of said menu confirmation device can be simplified.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A microwave oven with a microcomputer and a memory for cooking information in which heating is controlled according to a cooking program selected from the cooking information stored in the memory, said microwave oven comprising:

a cooking category selector used to select a specific cooking category based on the cooking information stored in the memory;

a cooking category display which displays the cooking category selected by the cooking category selector;

a menu display which simultaneously displays a plurality of menu names contained in the specific cooking category selected by the cooking category selector based on the cooking information stored in the memory; and a menu selector used to select a desired menu name from among the plurality of menu names displayed on the menu display, after selection of the desired menu name by the menu selector, the menu display only displays the selected menu name while remaining menu names in the specific cooking category are removed from the menu display.

2. The microwave oven as claimed in claim 1, wherein said microwave oven comprises an external data storage device which stores the cooking information to be stored in said memory.

3. The microwave oven as claimed in claim 2, wherein said microwave oven is provided with a menu image display comprised of a liquid crystal display used to display an image of finished appearance of a menu item selected by the menu selector.

4. The microwave oven as claimed in claim 3, wherein said microwave oven comprises a menu confirmation unit used to confirm selection of the menu item displayed on the menu image display.

5. The microwave oven as claimed in claim 4, wherein said menu confirmation unit utilizes the menu selector by two consecutive selections of the same menu item.

6. The microwave oven as claimed in claim 1, wherein said microwave oven is provided with a menu image display comprised of a liquid crystal display used to display an image of finished appearance of a menu item selected by the menu selector.

7. The microwave oven as claimed in claim 6, wherein said microwave oven comprises a menu confirmation unit used to confirm selection of the menu item displayed on the menu image display.

8. The microwave oven as claimed in claim 7, wherein said menu confirmation unit utilizes the menu selector by two consecutive selections of the same menu item.

* * * * *